US009410542B2

(12) United States Patent
Boey et al.

(10) Patent No.: US 9,410,542 B2
(45) Date of Patent: Aug. 9, 2016

(54) ULTRASONIC FLUID PRESSURE GENERATOR

(75) Inventors: Freddy Yin Chiang Boey, Singapore (SG); Jan Ma, Singapore (SG); Tao Li, Singapore (SG)

(73) Assignee: NANYANG TECHNOLOGICAL UNIVERSITY, Singapore (SG)

( * ) Notice: Subject to any disclaimer, the term of this patent is extended or adjusted under 35 U.S.C. 154(b) by 395 days.

(21) Appl. No.: 13/518,175

(22) PCT Filed: Dec. 22, 2009

(86) PCT No.: PCT/SG2009/000488
§ 371 (c)(1),
(2), (4) Date: Jun. 21, 2012

(87) PCT Pub. No.: WO2011/078786
PCT Pub. Date: Jun. 30, 2011

(65) Prior Publication Data

US 2012/0275941 A1 Nov. 1, 2012

(51) Int. Cl.
*F04B 17/03* (2006.01)
*F04B 19/16* (2006.01)
(Continued)

(52) U.S. Cl.
CPC ..... *F04B 17/03* (2013.01); *F04B 19/006* (2013.01); *F04B 19/02* (2013.01); *F04B 19/16* (2013.01); *F04B 19/20* (2013.01); *F04B 43/046* (2013.01)

(58) Field of Classification Search
CPC ..... F04B 17/003; F04B 19/00; F04B 19/006; F04B 39/0055; F04B 39/0088; F04B 43/046; F04B 19/20; F04B 19/16; F04B 19/02; F04B 17/04; F04B 17/046; H04L 41/22; H04L 41/09
USPC ..... 417/410.2, 572
See application file for complete search history.

(56) References Cited

U.S. PATENT DOCUMENTS 3,756,575 A * 9/1973 Cottell ..... 261/1
4,619,400 A * 10/1986 van der Burgt ..... 239/102.1
(Continued)

FOREIGN PATENT DOCUMENTS

BE 1013168 A3 10/2001
JP 63-198800 A 8/1988

OTHER PUBLICATIONS

International Preliminary Report on Patentability issued for International Application No. PCT/SG2009/000488 date Jul. 5, 2012.
(Continued)

*Primary Examiner* — Devon Kramer
*Assistant Examiner* — Timothy P Solak
(74) *Attorney, Agent, or Firm* — Sughrue Mion, PLLC

(57) ABSTRACT

An ultrasonic fluid pressure generator for generating high pressure head in a fluid. The ultrasonic fluid pressure generator comprises a transducer comprising a piezoelectric actuator and a displacement amplifier, the displacement amplifier having a fluid channel therethrough, the displacement amplifier being connected to the piezoelectric actuator at one end and having a free vibrating tip at another end; a reflecting condenser disposed at the vibrating tip of the displacement amplifier to form a gap between the vibrating tip and a reflecting surface of the reflecting condenser; and a casing configured for establishing a standing wave in the fluid contained within the casing, the transducer and the reflecting condenser being at least in part within the casing.

7 Claims, 6 Drawing Sheets

(51) Int. Cl.

| | |
|---|---|
| ***F04B 19/00*** | (2006.01) |
| ***F04B 19/20*** | (2006.01) |
| ***F04B 43/04*** | (2006.01) |
| ***F04B 19/02*** | (2006.01) |

(56) References Cited

U.S. PATENT DOCUMENTS

| | | | | | |
|---|---|---|---|---|---|
| 4,850,534 | A * | 7/1989 | Takahashi et al. | ..... | 239/102.2 |
| 5,465,468 | A * | 11/1995 | Manna | ..... | 29/25.35 |
| 6,659,740 | B2 * | 12/2003 | Drevet | ..... | 417/436 |
| 2003/0195468 | A1 * | 10/2003 | Lal et al. | ..... | 604/151 |
| 2009/0155091 | A1 * | 6/2009 | Ehlert | ..... | F04B 15/02 417/53 |

OTHER PUBLICATIONS

International Search Report for PCT/SG2009/000488 dated Mar. 10, 2010.

* cited by examiner

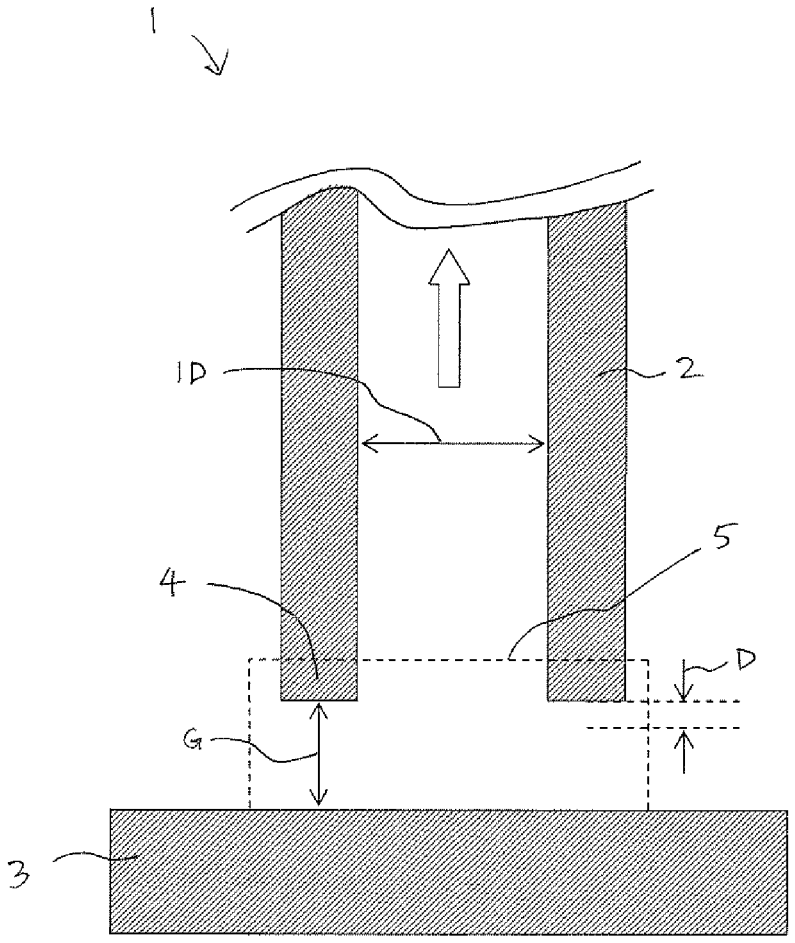
FIG. 1 (a) (prior art)

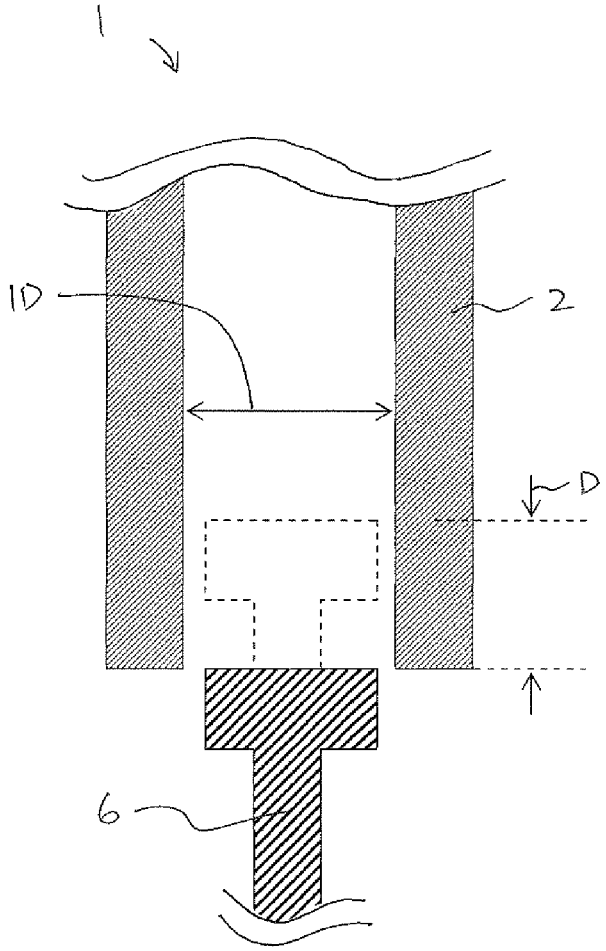
FIG. 1 (b) (prior art)

ULTRASONIC FLUID PRESSURE GENERATOR

CROSS REFERENCE TO RELATED APPLICATIONS

This application is a National Stage of International Application No. PCT/SG2009/000488 filed Dec. 22, 2009, the contents of which are incorporated herein by reference in their entirety.

TECHNICAL FIELD

The present invention relates to an ultrasonic fluid pressure generator. It particularly relates to an ultrasonic fluid pressure generator for generating high fluid pressure head for use as a pump, a pressure regulator, a hydraulic actuator or a microfluidic device.

BACKGROUND OF THE INVENTION

Rotary centrifugal pumps are conventionally used in industrial applications to induce flow of fluids via a pressure difference. The maximum pressure head that can be obtained depends on the external diameter of the impeller and the speed of the rotating shaft. Consequently, for high pressure head applications, a large rotary centrifugal pump is required, leading also to high power consumption.

However, it is often not feasible to use a large-sized pump especially where space is a constraint. Furthermore, it is desirable to have as low a power consumption as possible to improve efficiency and save energy.

Due to its valveless nature, ultrasonic pumps have been proposed. As shown in FIG. 1(*a*) (prior art), an ultrasonic pump 1 comprises chiefly a tube 2 with a plate 3 positioned at a gap G from the tip 4 of the tube 2. Either the tube 2 or the plate 3 is ultrasonically vibrated so as to create a displacement D in the gap G. This generates a pressure P in a region of the fluid 5 immediately between the tip 4 and the plate 3, thereby pushing water into the tube 2 as shown by the block arrow. The pressure P generated is a function of several parameters such as the gap G, internal diameter ID of the tube 2, vibration amplitude D and vibration frequency $f$ used. In an alternative embodiment, the ultrasonic pump comprises the tube 2 with an insertion rod 6 as shown in FIG. 1(*b*) (prior art).

As an example, an ultrasonic pump from Precision and Intelligence Laboratory of the Tokyo Institute of Technology uses a bending disk transducer to vibrate the plate 3. This achieved a maximum pump pressure of about 2 $mH_2O$ (or 20 kPa) with a vibration velocity of 1.0 m/s and a gap size of 10 μm, obtaining a maximum flow rate of 22.5 mL/min with input power of 3.8 W. Another ultrasonic pump from the same source uses a vibrating tube 2 (with or without the insertion rod 6) to achieve a similar maximum pump pressure. Although prototypes have been developed, the maximum pump pressure is still low for many practical applications, such as micro channel cooling.

SUMMARY OF THE INVENTION

According to a first aspect, there is provided an ultrasonic fluid pressure generator for generating high pressure head in a fluid. The ultrasonic fluid pressure generator comprises a transducer comprising a piezoelectric actuator and a displacement amplifier, the displacement amplifier having a fluid channel therethrough, the displacement amplifier being connected to the piezoelectric actuator at one end and having a free vibrating tip at another end; a reflecting condenser disposed at the vibrating tip of the displacement amplifier to form a gap between the vibrating tip and a reflecting surface of the reflecting condenser; and a casing configured for establishing a standing wave in the fluid contained within the casing, the transducer and the reflecting condenser being at least in part within the casing.

The reflecting condenser is preferably configured for focusing sound waves and improving sound pressure magnitude between the vibrating tip and the reflecting condenser, and may include a rod projecting from the reflecting surface into the fluid channel of the displacement amplifier without contacting the displacement amplifier. The reflecting condenser may further be configured to moveably engage the casing for adjusting pressure magnitude in the fluid.

The displacement amplifier preferably has a decreasing external dimension from the end connected to the piezoelectric actuator to the end having the free vibrating tip.

The piezoelectric actuator may have a tubular configuration, and preferably comprises a fluid channel therethrough, the fluid channel of the piezoelectric transducer being in fluid connection with the fluid channel of the displacement amplifier.

The transducer is preferably affixed to the casing at its nodal position.

BRIEF DESCRIPTION OF THE DRAWINGS

Exemplary embodiments will now be described with reference to the accompanying drawings, by way of example only, in which:

FIG. 1(*a*)(prior art) is a schematic cross-sectional front view of a prior art ultrasonic fluid pump;

FIG. 1(*b*)(prior art) is a schematic cross-sectional front view of another prior art ultrasonic fluid pump;

FIG. 3(*b*) is the vibrating tip of FIG. 3(*a*) with a reflecting surface of a reflecting condenser;

FIG. 3(*c*) is the vibrating tip of FIG. 3(*a*) with a short rod insert;

FIG. 3(*d*) is the vibrating tip of FIG. 3(*a*) and the reflecting condenser of the ultrasonic fluid pressure generator of FIG. 2;

DETAILED DESCRIPTION OF THE EMBODIMENTS

Figure 2:
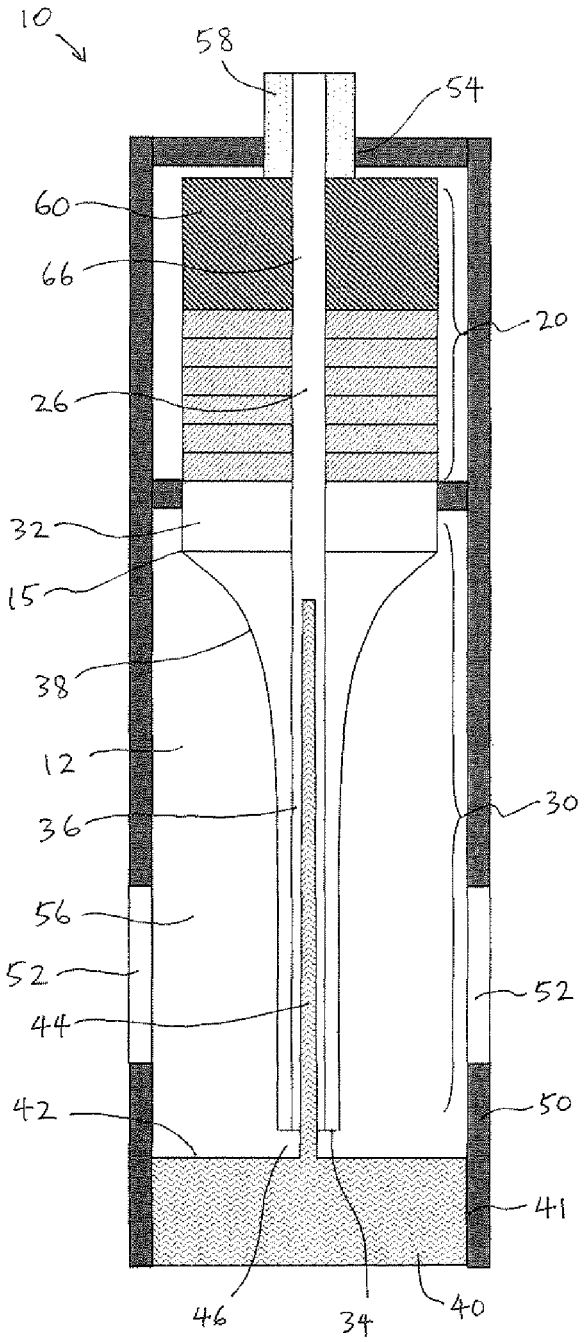
FIG. 2 is a schematic cross-sectional front view of an exemplary embodiment of an ultrasonic fluid pressure generator according to the present invention.
Figure 3A:
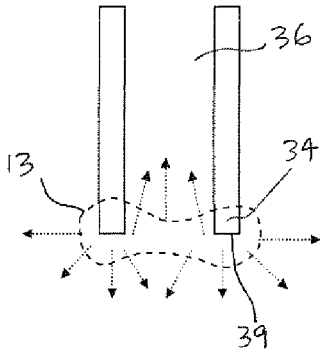
FIG. 3(*a*) is a schematic cross-sectional front close-up view of a vibrating tip of the ultrasonic fluid pressure generator of FIG. 2.
Figure 3B:
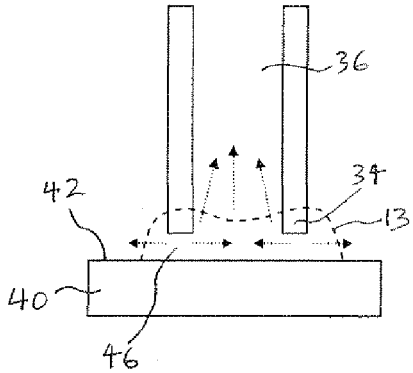
Figure 3C:
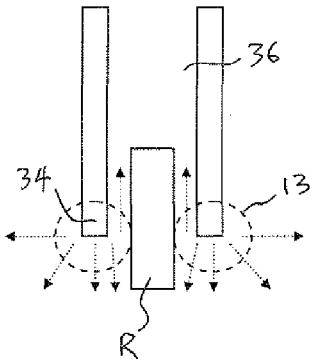
Figure 3D:
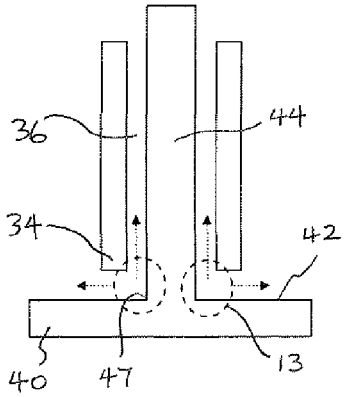

An ultrasonic fluid pressure generator 10 capable of generating high pressure head as shown in FIG. 2, which is an exemplary embodiment of the invention, will now be described. As a result of the high pressure head that can be produced, the ultrasonic fluid pressure generator 10 may serve not only as a fluid pump, but may also be used as a pressure regulator, a hydraulic actuator or a microfluidic device.

As shown in FIG. 2, the exemplary embodiment of the ultrasonic fluid pressure generator 10 comprises a transducer 15, a reflecting condenser 40 and a casing 50 enveloping the transducer 15 and the reflecting condenser 40. The transducer 15 further comprises a piezoelectric actuator 20 and a displacement amplifier 30.

The transducer 15 is configured for effecting one-dimensional longitudinal vibration in a fluid 12 contained within the casing 50 so that as sound waves propagate in the fluid 12, pressure patterns are generated in the fluid 12. Preferably, the transducer 15 has a power consumption as low as 1 Watt, a frequency range of 10 to 100 kHz and a vibration amplitude with an operational vibration velocity range of 0 to 5 m/s. The piezoelectric actuator 20 which serves as a driving component of the transducer 15 may be of a multilayer piezoelectric stack 20 as shown, or have a tubular configuration. Total length of the transducer 15 may be a multiple of a half a wavelength, while length of the piezoelectric actuator 20 is preferably a multiple of a quarter or half of a wavelength. The piezoelectric actuator 20 is preferably clamped between the displacement amplifier 30 and an end-cap 60 as shown.

The displacement amplifier 30 of the transducer 15 is connected to the piezoelectric actuator 20 at one end 32 while having a free vibrating tip 34 at another end. The displacement amplifier 30 has a fluid channel 36 therethrough, and is preferably made of a metal such as titanium or an equivalent for generating high vibration velocity while being corrosion resistant. The displacement amplifier 30 is configured to have a decreasing external dimension 38 from the end 32 connected to the piezoelectric actuator 20 to the end having the free vibrating tip 34. In this way, high vibration amplitude is achieved at the vibrating tip 34 while requiring lower vibration velocity of the piezoelectric actuator 20. Consequently, less heat is generated by the piezoelectric actuator 20, thereby improving reliability of the transducer 15. In the preferred embodiment, the piezoelectric actuator 20 and the end-cap 60 also comprise fluid channels 26 and 66 respectively, wherein all the fluid channels 36, 26, 66 are in fluid connection with one another, thereby forming a continuous through-hole in the transducer 15 as shown in FIG. 2.

By providing a displacement amplifier 30 with a vibrating tip 34 of a reduced cross-sectional area compared to the piezoelectric actuator 20, an overall vibration amplification ratio of about 15 to 20 is obtained. This results in high pressure generation in the fluid 12 as pressure becomes focused at a region 13 of the fluid 12 around a rim 39 of the tip 34 as shown in FIG. 3(*a*), where arrows indicate direction of fluid flow and dashed lines indicate a maximum pressure region 13.

Impedance of the fluid pressure generator 10 is therefore adjusted by providing the displacement amplifier 30 so as to lower power required of the piezoelectric actuator 20. Ensuring a smooth decrease in external dimension 38 of the displacement amplifier 30 results in lower overall system energy loss and also reduces bending vibration of the displacement amplifier 30.

The reflecting condenser 40 engages the casing 50 to form a seal 41 between the reflecting condenser 40 and the casing 50. The reflecting condenser 40 comprises a reflecting surface 42 that is preferably circular in shape and large enough to cover the cross-sectional area of the amplifier tip 34. The reflecting surface 42 may be flat as shown, or also curved. The reflecting condenser 40 is disposed at the vibrating tip 34 of the displacement amplifier 30 so as to form a gap 46 between the vibrating tip 34 and the reflecting surface 42, as shown in FIG. 3(*b*). Downward vertical flow as shown in FIG. 3(*a*) is thus reduced or eliminated by the reflecting surface 42 as can be seen in the absence of downwardly directed arrows in FIG. 3(*b*). The size of the gap 46 may be adjusted by configuring the reflecting condenser 40 to moveably engage the casing 50 for adjusting pressure magnitude in the fluid region 13, wherein movement of the reflecting condenser 40 may be actuated by appropriate means such as adjustment screws.

While a short rod R alone inserted into the fluid channel 36 of the transducer 15 reduces horizontal flow as shown in FIG. 3(*c*), too long a rod R by itself will halt fluid flow up the fluid channel 36 as a result of downward flow being greater than upward flow around the rod R. In the preferred embodiment of the fluid pressure generator 10 of the present invention, therefore, the reflecting condenser 40 has a ⊥-shape, comprising a rod 44 together with the reflecting surface 42 as shown in FIG. 3(*d*). The rod 44 projects from the reflecting surface 42 into the fluid channel 36 of the displacement amplifier 30 without contacting the displacement amplifier 30. By providing the ⊥-shaped reflecting condenser 40, useless flow in both the downward and horizontal directions is reduced or eliminated. A well defined flow path is thus created with the use of the ⊥-shaped reflecting condenser 40 together with the displacement amplifier 30, thereby increasing efficiency.

By providing the reflecting surface 42 together with the rod 44, the rod 44 may be of unlimited length within the fluid channel 36 of the displacement amplifier 30 as downward flow is prevented by the reflecting surface 42. However, when the length of the rod 44 is a multiple of a quarter of the wavelength, the pressure wave is more focused at the vibrating tip 34.

The ⊥-shaped reflecting condenser 40 also reduces the area of pressure distribution when compared to using only the reflecting surface 42 alone (FIG. 3(*b*)) or the short rod R alone (FIG. 3(*c*)). This is due to the ⊥-shaped reflecting condenser 40 providing a corner ring 47 that focuses energy generated by the transducer 15. In the preferred embodiment as shown in FIG. 3(*d*), the corner ring 47 has a sharp right angle which focuses pressure between itself 47 and the amplifier tip 34. This produces a new area of focusing below the vertical flow path that more effectively directs fluid 12 into the fluid channel 36. Other embodiments of the corner ring 47 such as a concave design may be provided to focus the pressure wave more effectively.

As shown in FIG. 2, the transducer 15 and the reflecting condenser 40 are enveloped by the casing 50. The casing 50 is configured for establishing a standing wave in the fluid 12 contained in a liquid cavity 56 within the casing 50. The liquid cavity 56 is defined or bound by the casing 50, the displacement amplifier 30, and the reflecting condenser 40. The transducer 15 and the reflecting condenser 40 should therefore be at least in part within the casing 50. For example, in an alternative embodiment, the piezoelectric actuator 20 may be external to the casing 50. Wavelength of the standing wave established in the liquid cavity 56 may range from zero to infinity in any direction.

Figure 4:
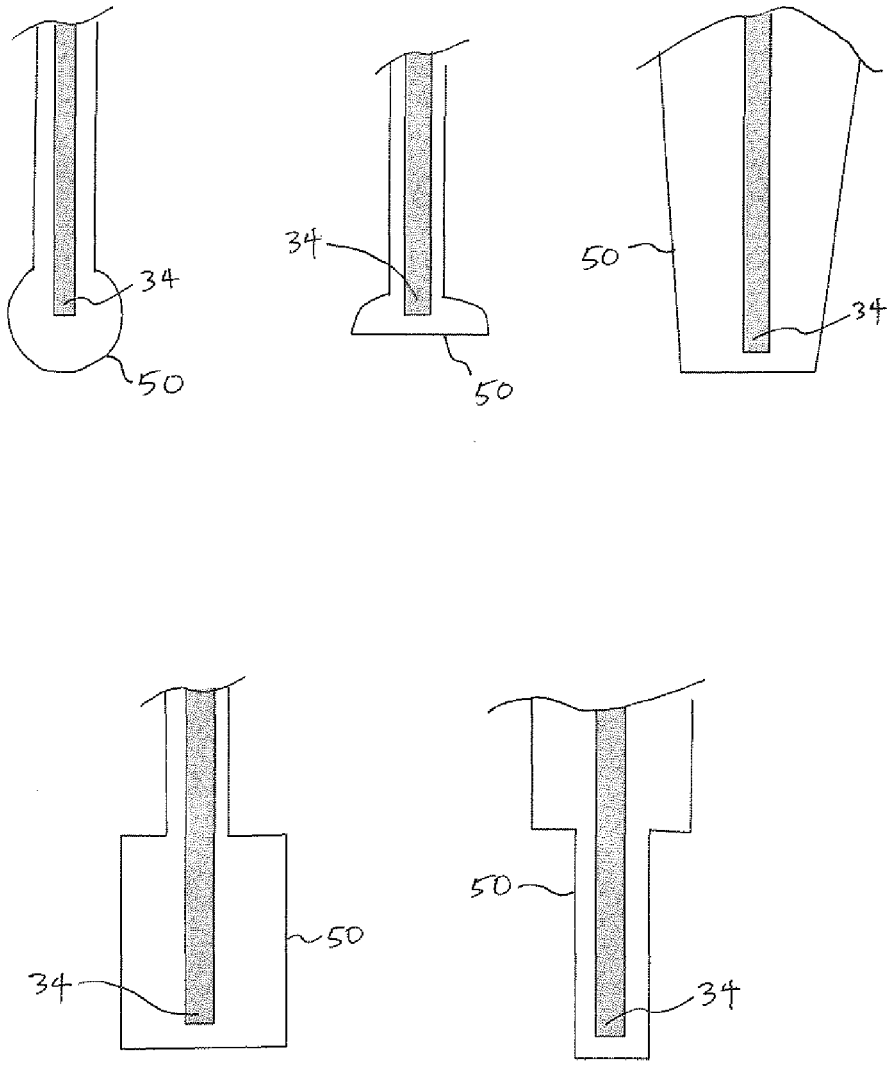
FIG. 4 is a schematic view of alternative embodiments of a casing of the ultrasonic fluid pressure generator.

The casing 50 is provided with at least an inlet 52 for in-flow of the fluid 12. In the embodiment shown in FIG. 2, the casing 50 is also provided with an outlet 54 for liquid out-flow, the outlet 54 being connected to the end-cap 60 of transducer 15 via an out-flow connecting tube 58. The casing 50 is preferably cylindrical in shape and may have an inner diameter less than a quarter wavelength and a liquid cavity length being multiples of half a wavelength so as to create resonance of the fluid 12 in the cavity 56. The casing 50 should be made of an acoustically hard material such as aluminium in order to reflect the sound wave generated in the fluid 12, so as to reduce energy loss induced in the fluid 12. In the preferred embodiment, the transducer 15 is affixed to the casing 50 to form a seal at a nodal position of the transducer 15 itself. The inlet 52 should be positioned on the casing so as not to affect the standing wave condition created in the fluid 12. Alternative embodiments of the casing 50 are shown in FIG. 4, wherein the casing 50 may be spherical, semi-spherical, stepped, conical, and so forth.

By establishing a standing wave condition in the fluid 12, the casing reduces power consumption required by the transducer 15. This in turn increases sound pressure at the amplifier tip 34. In an ideal case, the standing wave condition would not affect power consumption and vibration displacement of the transducer 15 as all the power will be reflected from the boundary. By forming a seal between the casing 50 and the transducer 15, as well as a seal between the casing 50 and the reflecting condenser 40, the generated sound wave is confined within the liquid cavity 56. The displacement amplifier 30 thus forms a first order focusing, the reflecting condenser 40 a second order focusing and the casing 50 a third order focusing.

As shown in Table 1 below, with the casing alone, improvement in sound pressure can be up to two times the pressure obtained without the casing 50, as a result of the casing 50 forming a reflective boundary condition in the fluid 12. Using the casing 50 together with the reflecting condenser 40, the sound pressure can be increased by 14 times as the casing 50 and reflecting condenser 40 together restrain and focus the sound wave in a limited space within the casing 50, thereby producing high static pressure which induces fluid flow towards the outlet 54.

TABLE 1

| Condition | Pressure magnitude (dB) | Pressure magnitude (kPa) | Improvement |
|---|---|---|---|
| Without casing | 193 | 89 | 1 |
| With casing | 199 | 178 | ~2 |
| With casing and reflecting condenser | 216 | 1262 | ~14 |

Figure 5:
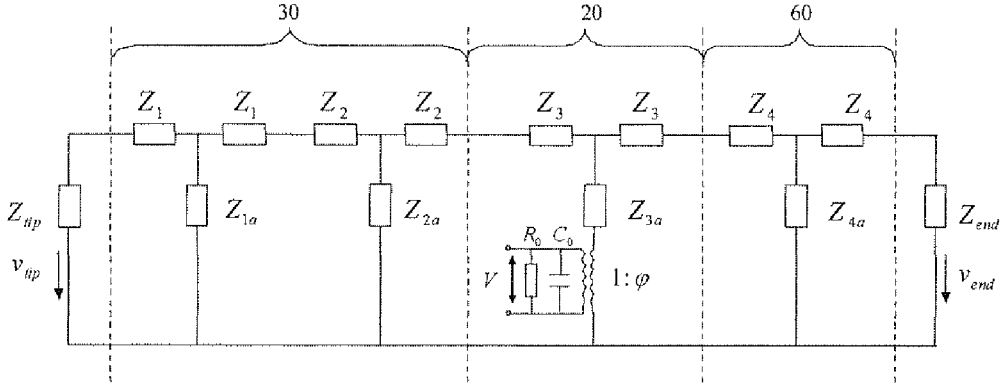
FIG. 5 is an electric circuit diagram representing a transducer of the ultrasonic fluid pressure generator of FIG. 2.

To appropriately configure the fluid pressure generator 10 for optimizing performance, the piezoelectric transducer 15 is represented as an electric circuit model as shown in FIG. 5, where each section of the transducer 15, i.e. the displacement amplifier 30, the piezoelectric actuator 20 and the end-cap 60 are each represented by an appropriate electric circuit component accordingly.

In the circuit, $Z_{tip}$ is the radiation impedance at the amplifier tip 34. $Z_{end}$ is the back load from the air. $C_o$ is clamped capacitance of the piezoelectric actuator 20, $R_o$ is dielectric resistance, $\phi$ is electromechanical conversion coefficient ($\phi = S/L \cdot d_{33}/s_{33}^E$), $v_{tip}$ and $v_{end}$ are the vibration velocities at the amplifier tip 34 and an end of the actuator 20, respectively. The parallel and series impedances Z in FIG. 5 are given by the following expressions:

$$Z_1 = j\rho_1 c_1 S_1 \tan\frac{k_1 l_1}{2} \quad (1)$$

$$Z_{1a} = \frac{-j\rho_1 c_1 S_1}{\sin k_1 l_1} \quad (2)$$

$$Z_2 = j\rho_2 c_2 S_2 \tan\frac{k_2 l_2}{2} \quad (3)$$

$$Z_{2a} = \frac{-j\rho_2 c_2 S_2}{\sin k_2 l_2} \quad (4)$$

$$Z_3 = j\rho_3 c_3 S_3 \tan\frac{n k_3 l_3}{2} \quad (5)$$

-continued $$Z_{3a} = \frac{-j\rho_3 c_3 S_3}{\sin n k_3 l_3} \quad (6)$$

$$Z_4 = j\rho_4 c_4 S_4 \tan\frac{k_4 l_4}{2} \quad (7)$$

$$Z_{4a} = \frac{-j\rho_4 c_4 S_4}{\sin k_4 l_4} \quad (8)$$

In the above expressions, $\rho_i$, $c_i$, $S_i$, $k_i$, $l_i$ (i=1, 2, 3, 4) are density, sound speed, area of cross section, wave number and length for each section respectively, while n is the number of elements in the piezoelectric stack forming the piezoelectric actuator 20. Before solving the circuit, the following parameters are defined:

$$Z_5 = \frac{Z_{1a}(Z_1 + Z_2)}{(Z_{1a} + Z_1 + Z_2 + Z_{2a})} \quad (9)$$

$$Z_6 = \frac{Z_{2a}(Z_1 + Z_2)}{(Z_{1a} + Z_1 + Z_2 + Z_{2a})} \quad (10)$$

$$Z_7 = \frac{Z_{1a} Z_{2a}}{(Z_{1a} + Z_1 + Z_2 + Z_{2a})} \quad (11)$$

$$Z_8 = Z_1 + Z_{tip} + Z_5 \quad (12)$$

$$Z_9 = Z_6 + Z_2 + Z_3 \quad (13)$$

$$Z_{10} = Z_3 + Z_4 \quad (14)$$

$$Z_{11} = Z_{end} + Z_4 \quad (15)$$

$$Z_f = \frac{Z_8 Z_7}{Z_8 + Z_7} + Z_9 \quad (15)$$

$$Z_b = \frac{Z_{4a} Z_{11}}{Z_{4a} + Z_{11}} + Z_{10} \quad (15)$$

The circuit is then solved to obtain important parameters as listed below, where:

impedance of vibration system is $$Z = \frac{Z_f Z_b}{Z_f + Z_b} + Z_{3a} \quad (16)$$

velocity at the end is $$v_{end} = \frac{Z_{4a}}{Z_{4a} + Z_{11}} \frac{Z_f}{Z_f + Z_b} \frac{\varphi V}{Z} \quad (17)$$

velocity at the tip 34 is $$v_{tip} = \frac{Z_7}{Z_7 + Z_g} \frac{Z_b}{Z_f + Z_b} \frac{\varphi V}{Z} \quad (18)$$

and power consumption of the transducer 15 is $$P = \frac{1}{2}\left(\frac{1}{R_0} + \mathrm{Re}^i\left(\frac{\varphi^2}{Z}\right)\right)V^2. \quad (19)$$

Table 2 below shows experimental performance results of the fluid pressure generator 10 under different conditions.

TABLE 2

| Condition | Power consumption (W) | Flow rate (mL/min) | Pressure head (mH2O) |
|---|---|---|---|
| Without casing; without reflecting condenser | ~6 | 3.2 | 0.01 |
| Without casing; with flat reflecting condenser | ~1.5 | 9.2 | 1.6 |
| With casing; with ⊥-shaped reflecting condenser | ~0.6 | 9.2 | 24 |

It can be seen that where a flat reflecting condenser is used without a casing, the ultrasonic pressure generator 10 is effectively the same as the prior art ultrasonic fluid pump as shown in FIG. 1(*a*)(prior art) and achieves only a pressure head of 1.6 $mH_2O$.

However, by providing the casing 50 together with the ⊥-shaped reflecting condenser 40 in the ultrasonic pressure generator 10 of the present invention, for the same flow rate of 9.2 mL/min, a pressure head of 24 $mH_2O$ is achieved while power consumption is reduced from 1.5 W to 0.6 W. This is an improvement of 15 times the pressure head that can be obtained by a known ultrasonic pump, while reducing power consumption by 2.5 times.

Furthermore, as shown in Table 3 below, in comparison with three different centrifugal pumps, it can be seen that for an equivalent power consumption of around 1 W, the RS M200-S-SUB having small external dimensions of 15.7×15.7×28.5 mm can only reach a pressure head of 1.9 $mH_2O$, while the ultrasonic fluid pressure generator 10 of the present invention achieves a maximum pressure head of 30 $mH_2O$, an improvement of nearly 16 times for the same power consumption.

TABLE 3

| Device | Dimension (mm) | Power consumption (W) | Pressure head ($mH_2O$) |
|---|---|---|---|
| Centrifugal pump RS M200-S-SUB | 15.7 × 15.7 × 28.5 | 0.8-1.5 | 1.9 |
| Centrifugal pump SWIFTECH MCP655 | 108 × 90 × 88 | 24 | 3.1 |
| ZHEJIANG LEO CO., LTD., Micro Centrifugal pump | 383 × 233 × 278 | 1100 | 33 |
| Ultrasonic Fluid Pressure Generator | OD16 × 120 | ~1 | 30 |

Comparing the ultrasonic fluid pressure generator 10 of the present invention with a centrifugal pump of similar size such as the SWIFTECH MCP655, the centrifugal pump consumes some 24 times more power while achieving a pressure head of about 10 times less.

To achieve a similar pressure head as the ultrasonic fluid pressure generator 10 of the present invention, it can be seen that a much bigger centrifugal pump such as the ZHEJIANG LEO CO., LTD., micro centrifugal pump will be required, which consumes over 1000 times the power used by the ultrasonic fluid pressure generator 10 of the present invention.

The performance of the ultrasonic fluid pressure generator 10 of the present invention thus greatly exceeds that of all known embodiments of existing ultrasonic fluid pumps, as well as known embodiments of centrifugal pumps having an equivalent size, or power consumption, or pressure head output.

It should be appreciated that the invention has been described by way of example only and that various modifications in design and/or detail may be made without departing from the scope of this invention.

The invention claimed is:

1. An ultrasonic fluid pressure generator for generating high pressure head in a fluid, the ultrasonic fluid pressure generator comprising:

a transducer comprising a piezoelectric actuator and a displacement amplifier, the displacement amplifier having a fluid channel therethrough, the displacement amplifier being connected to the piezoelectric actuator at one end and having a free vibrating tip at another end;

a reflecting condenser disposed at the vibrating tip of the displacement amplifier to form a gap between the vibrating tip and a reflecting surface of the reflecting condenser; and a casing configured for establishing a standing wave in the fluid contained within the casing, the transducer and the reflecting condenser being at least in part within the casing, wherein fluid is taken in through the vibrating tip into the fluid channel of the displacement amplifier, and wherein the reflecting condenser is configured to moveably engage the casing for adjusting pressure magnitude in the fluid.

2. The ultrasonic fluid pressure generator of claim 1, wherein the reflecting condenser is configured for focusing sound waves and increasing sound pressure magnitude between the vibrating tip and the reflecting condenser.

3. The ultrasonic fluid pressure generator of claim 1, wherein the reflecting condenser includes a rod projecting from the reflecting surface into the fluid channel of the displacement amplifier without contacting the displacement amplifier.

4. The ultrasonic fluid pressure generator of claim 1, wherein the displacement amplifier has a decreasing external dimension from the end connected to the piezoelectric actuator to the end having the free vibrating tip.

5. The ultrasonic fluid pressure generator of claim 1, wherein the piezoelectric actuator comprises a fluid channel therethrough, the fluid channel of the piezoelectric transducer being in fluid connection with the fluid channel of the displacement amplifier.

6. The ultrasonic fluid pressure generator of claim 1, wherein the transducer is affixed to the casing at a nodal position of the transducer.

7. The ultrasonic fluid pressure generator of claim 1, wherein the piezoelectric actuator has a tubular configuration.

* * * * *